US006738250B2

(12) United States Patent
Joseph et al.

(10) Patent No.: US 6,738,250 B2
(45) Date of Patent: May 18, 2004

(54) LATCHABLE RELAY

(75) Inventors: Peter D. Joseph, Twin Lakes, WI (US); Kenneth A. Albrecht, Zion, IL (US)

(73) Assignee: The Cherry Corporation, Waukegan, IL (US)

( * ) Notice: Subject to any disclaimer, the term of this patent is extended or adjusted under 35 U.S.C. 154(b) by 107 days.

(21) Appl. No.: 10/190,132

(22) Filed: Jul. 3, 2002

(65) Prior Publication Data

US 2004/0004803 A1 Jan. 8, 2004

(51) Int. Cl.[7] ..... H01H 47/00

(52) U.S. Cl. ..... 361/144; 361/160; 361/166; 361/183

(58) Field of Search ..... 361/144, 147, 361/148, 160, 161, 166, 172, 183

(56) References Cited

U.S. PATENT DOCUMENTS 4,438,377 A * 3/1984 Sakai et al. ..... 318/254
5,631,517 A * 5/1997 Kato et al. ..... 310/323.02
6,097,123 A * 8/2000 Weiss et al. ..... 310/105

* cited by examiner

*Primary Examiner*—Anthony Dinkins
(74) *Attorney, Agent, or Firm*—Brinks Hofer Gilson & Lione

(57) ABSTRACT

A solenoid-actuated latchable relay is controlled by a microprocessor that turns on at least one triac to selectively energize a solenoid coil with a desired polarity energization signal. The triac is only operated momentarily so that a single energization pulse is applied to the coil to move an associated magnetic plunger to a position corresponding to the polarity of the pulse. The magnetic plunger is latched in this position until another pulse is applied to change the position.

22 Claims, 7 Drawing Sheets

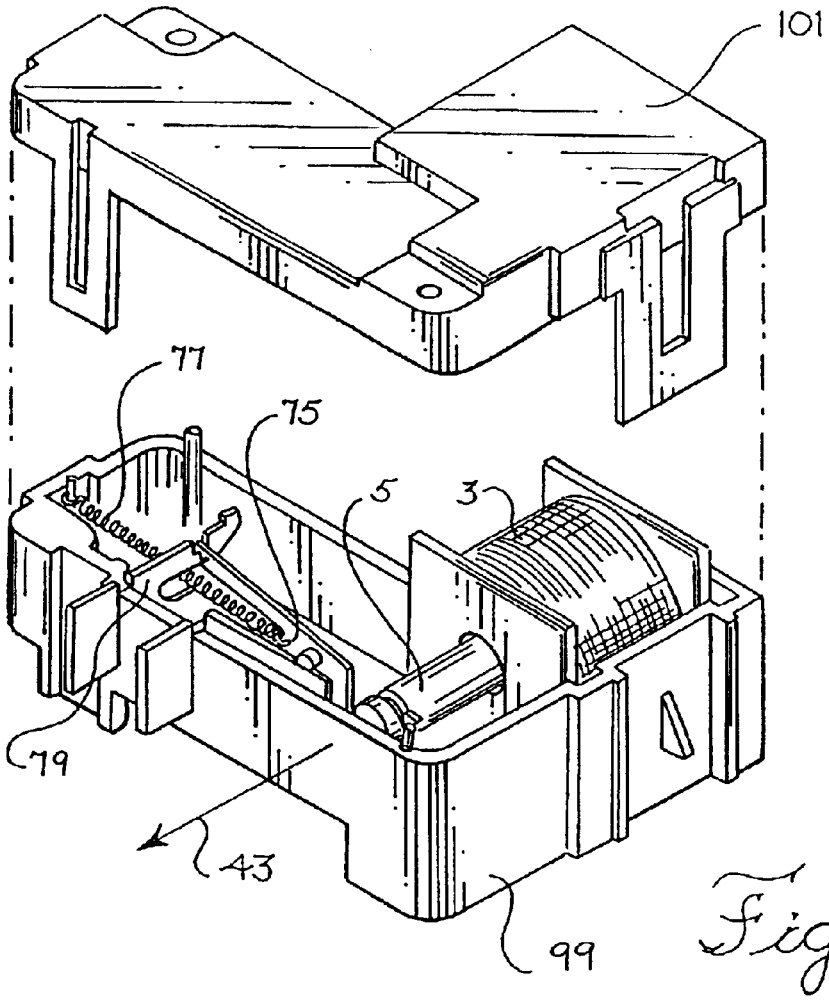
Fig. 5
Fig. 6
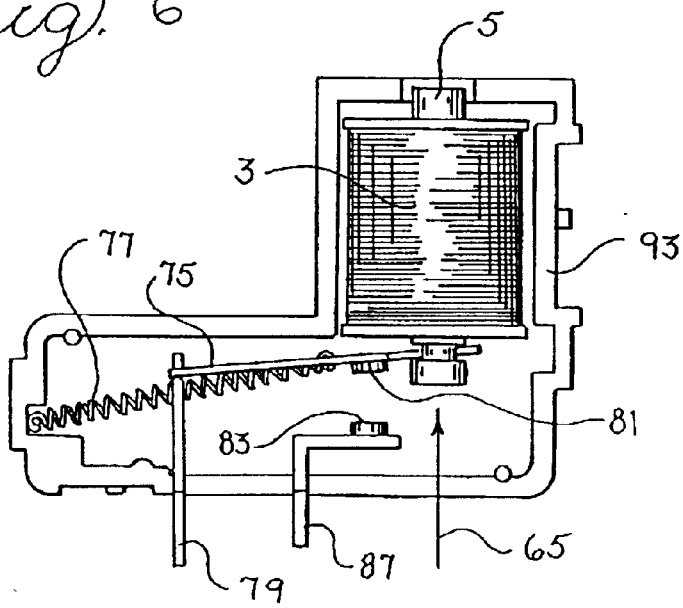

LATCHABLE RELAY

BACKGROUND OF THE INVENTION

1. Technical Field of the Invention

The invention concerns a solenoid-actuated latchable relay that operates in response to Alternating Current (AC). More particularly, the invention concerns such a relay that is controlled by a microprocessor to operate electrical devices such as motors and refrigeration equipment.

2. Description of Related Art

It has long been known that switching relays may be operated with solenoids. A solenoid is an electromagnet that has an energized coil approximately cylindrical in form, with an armature or plunger that moves in response to energization of the coil. Typically, the armature or plunger reciprocates along its axis within and along the axis of the coil when the coil is energized by a Direct Current (DC) signal. It is known that the armature or plunger may open and close relay contacts in response to energization of the coil.

Direct current energization has typically been used to operate solenoids. Thus, for example, a DC signal of a particular polarity is typically applied to continuously energize the coil of the solenoid and hold the plunger or armature in a desired operational position. One disadvantage of this operation is that power is continuously dissipated in order to continuously energize the coil and thereby maintain the solenoid in a desired operational position. Another disadvantage of such solenoids is that they are not amenable to operation in an AC electrical environment unless the energization signal for the solenoid is rectified. Also, for many uses of solenoids, a change in the polarity of the signal applied to the coil does not define a different operational condition.

Accordingly, it would be desirable to have a solenoid-actuated relay that operates with an AC energization signal, for example, the standard 60-hertz power signal that is used in the United States or the 50 hertz power signal used abroad. It would also be desirable to provide such a relay with different operational conditions in response to a change in polarity of the energizing AC signal. Further advantages could be achieved by surface mounting the relay to printed circuit boards and making the relay latchable so that it maintains its operational state without requiring the application of continuous power. Such relays would be particularly desirable for use in controlling AC electrical devices, for example, motors, compressors, evaporators and even heaters for various uses, including refrigeration equipment.

SUMMARY OF THE INVENTION

The invention concerns a solenoid-actuated latchable relay that may be used to control any mechanical or electrical devices, including motors, compressors, evaporators and heaters, particularly for use in refrigeration. The invention concerns controlling the operation of a solenoid relay by use of a triac that applies AC energization signals of selected polarity to a coil of the relay. As an example, one polarity would define one associated operational state of the solenoid-actuated relay such as closing switch contracts, and the reverse polarity would define an opposite operational state, such as opening the switch contracts.

The triac is controlled by a microprocessor that selects positive or negative portions of the AC power signal as required to energize the coil of the solenoid. Thus, for example, a portion of the positive cycle of the AC signal energizes the solenoid with a single positive polarity pulse and closes relay contacts to turn on an electrical apparatus. A latching mechanism holds the contacts in the closed position without continuously energizing the solenoid. The negative cycle of the AC input signal is selected by the microprocessor to energize the solenoid with a negative polarity pulse and thereby open the switch contacts which are then held open by the latching mechanism.

The switchable latching relay of the invention can be surface mounted on printed circuit boards and used to control the operation of any desired mechanical or electrical equipment, including motors, compressors, evaporators and heaters such as are employed to operate refrigerators. These and other benefits and features of the latchable relay of the invention will become apparent upon consideration of the following detailed description and accompanying drawings of presently preferred embodiments.

BRIEF DESCRIPTION OF THE DRAWINGS

FIG. 5 is a perspective illustration of another embodiment of a relay actuated to close switch contacts and mounted in a housing.

FIG. 6 is a plan view of the embodiment of FIG. 5 actuated to open switch contacts.

DETAILED DESCRIPTION OF THE INVENTION

Figure 1:
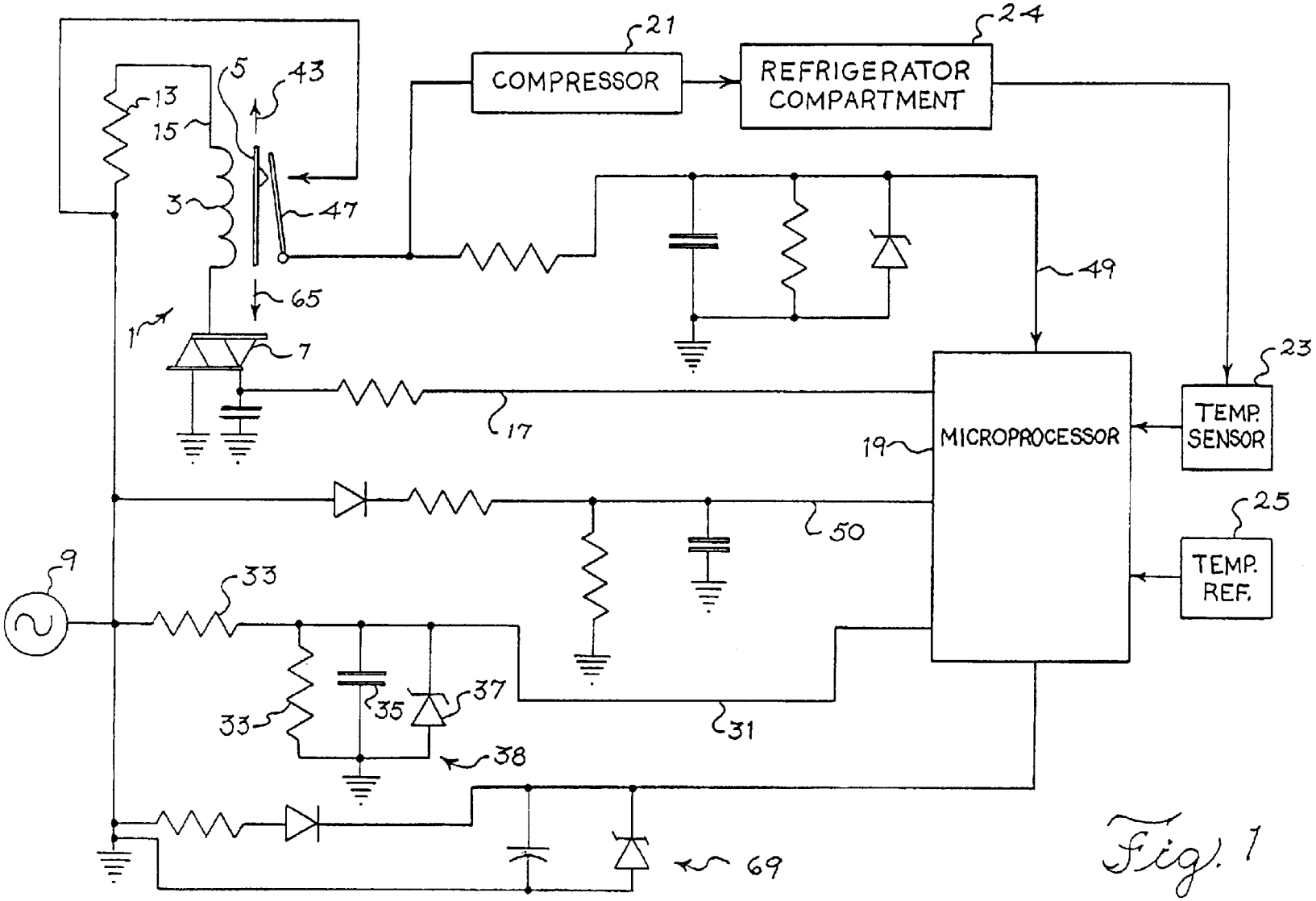
FIG. 1 is a schematic and block diagram of a circuit for operating the latchable relay of the invention.

FIG. 1 is a schematic and block diagram of a circuit for operating a solenoid-actuated latchable relay that controls energization of a compressor. It should be understood that, although the circuit of FIG. 1 is shown to turn on and off a compressor, it could be used to control any electrical apparatus.

Figure 2:
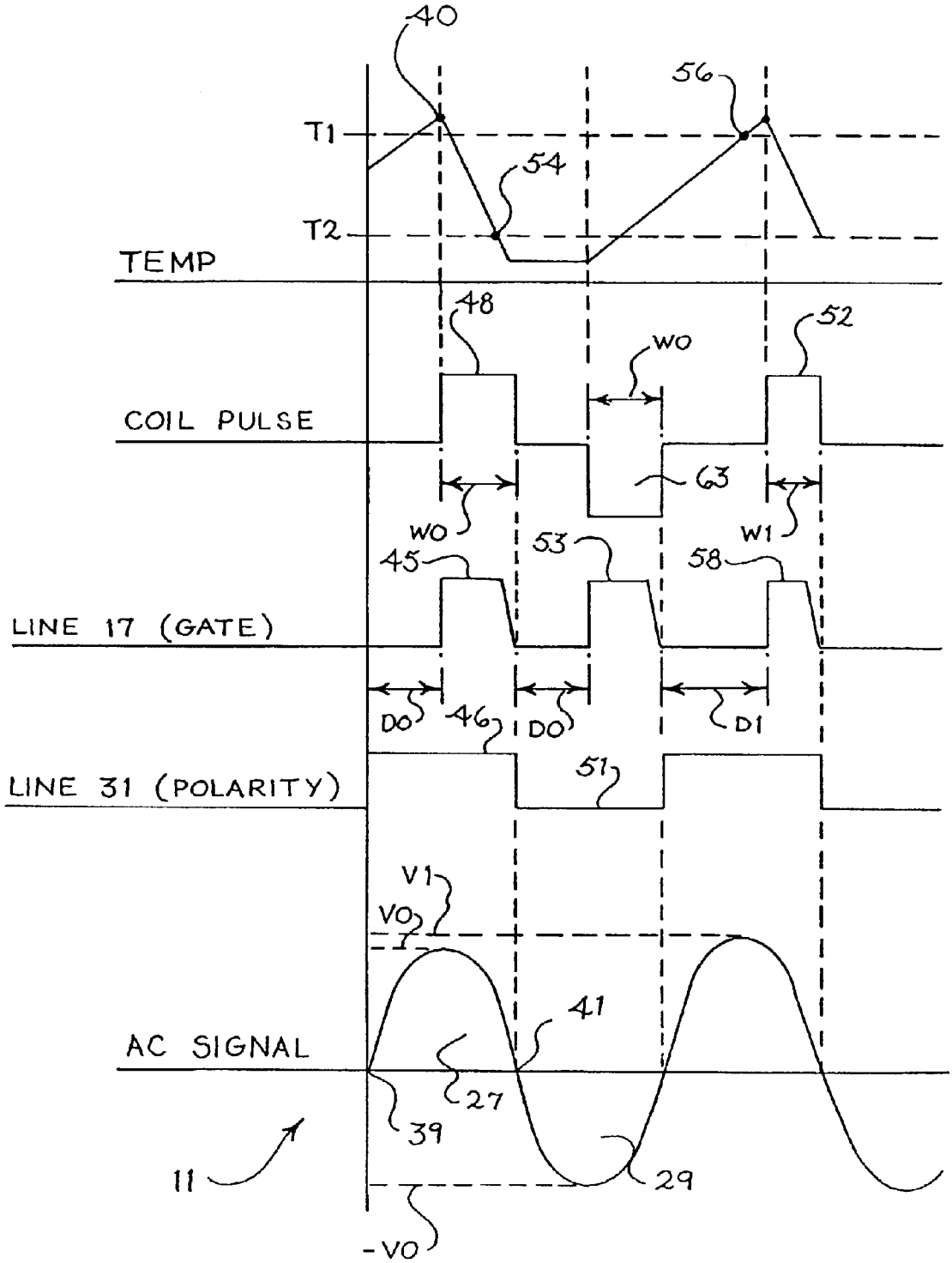
FIG. 2 is a timing diagram of various electrical signals that operate the circuit of FIG. 1.

As shown in FIG. 1, a solenoid-actuated latchable relay 1 has a conventional solenoid coil 3 and an associated slideable magnetic armature, plunger or magnet 5 that reciprocates along its axis in response to the polarity of energization signals applied to the coil. A triac 7 is provided to selectively apply positive cycle or negative cycle signals from an AC source 9 to the coil 3. As an example, the AC source 9 generates an alternating current power signal of about 120 volts and 60 hertz as is commonly used in the United States. FIG. 2 illustrates a diagram of the sinusoidal variation of this AC signal 11 over time. It should be understood that other types of AC signals could also be used.

As shown in FIG. 1, the sinusoidal power signal 11 is applied to a resistor 13 at the input side 15 of the coil 3. The triac 7 is connected at the opposite end of the coil and appears as an open circuit that prevents energization of the coil for as long as a gate 17 of the triac is not actuated. Thus, the coil 3 remains de-energized for as long as the gate 17 is turned off.

A microprocessor 19 is provided in the circuit of FIG. 1 to control activation and de-activation of the gate 17 of the triac 7. As an example, a Motorola microprocessor model 68HC908 may be employed. Of course, any other suitable microprocessor could be used without departing from the invention.

The microprocessor 19 is programmed in a conventional manner to determine when to turn on or off a compressor 21, for example as may be used in a refrigeration system. The microprocessor makes this determination in light of a signal from a temperature sensor 23 that is disposed to sense the temperature in a refrigeration compartment 24 associated with the compressor 21.

The temperature sensor 23 applies a signal to the microprocessor that corresponds to the sensed temperature within the refrigeration compartment. A reference temperature signal generator 25 is used in a conventional manner to determine the actual temperature that is sensed by the sensor 23. The program of the microprocessor 19 reviews the temperature information and, if the temperature is sufficiently high, activates the compressor 21. On the other hand, if the sensed temperature is sufficiently low, the microprocessor 19 will cause the compressor 21 to turn off. The microprocessor therefore cycles the compressor on and off to maintain a desired temperature within the refrigeration compartment.

In operation of the circuit of FIG. 1, the microprocessor 19 controls turning on and turning off the compressor 21 by applying a control signal to the gate 17 of the triac 7. The microprocessor activates or de-activates the compressor by using the positive phase 27 or negative phase 29 of the AC sinusoidal power signal 11. The microprocessor 19 determines whether the positive or negative phase of the AC power signal is active by sensing an associated positive or negative zero crossing signal generated on an input line 31 by a zero crossing sensing circuit 38.

The signal on the input line 31 therefore reflects the positive or negative state of the AC power signal. As shown in FIG. 1, resistors 33, a capacitor 35 and a Zener diode 37 of the circuit 38 are coupled as shown to detect the zero crossing points such as 39, 41 of the AC signal 11 of FIG. 2. Thus, for example, after a positive zero crossing point 39 of the AC signal 11, the zero crossing sensor circuit 38 applies a high logic level signal 46 on the line 31 until the following negative zero crossing at 41. The high signal 46 indicates the time at which the AC power signal is in its positive phase 27. Likewise, the zero crossing sensor circuit 38 applies a negative logic signal 51, for example, starting at a zero crossing point 41 and continuing for as long as the AC power signal is in its negative phase 29. The positive or negative logic states 46, 51 on the microprocessor input line 31 therefore indicate either a positive phase or a negative phase AC power signal at the input side 15 of the coil 3.

When the compressor is de-energized, the temperature within the refrigeration compartment increases to a maximum allowed temperature T1 shown at 40 in FIG. 2. At this point, the microprocessor program decides to turn on the compressor to cool down the refrigeration compartment. Therefore, it is desired to energize the coil 3 with a positive phase polarity 27 of the sinusoidal power signal 11 in order to turn on the compressor by moving the magnetic plunger or magnet 5 in the positive direction shown by an arrow 43. The microprocessor 19 will therefore energize the triac gate 17, for example with an energization gate pulse 45, when a positive logic signal 46 on the input line 31 indicates a positive zero crossing point 39 for the power signal. Thus, the triac 7 will be turned on for a time shown in FIG. 2 that is sufficient to allow a positive voltage pulse 48 to momentarily energize the coil 3 and cause the magnetic plunger or magnet 5 to move in the direction of the arrow 43 and thereby close an associated switch 47. The closed switch 47 energizes the compressor 21 and a signal is applied at 49 to confirm to the microprocessor that the compressor 21 is energized.

It should be understood that in the described operation only a single pulse 48 of positive voltage, with a pulse width W0 of about 8.3 milliseconds, is passed through the triac 7 to momentarily energize the coil 3 with the desired voltage polarity and thereby provide an associated magnetic field that moves the magnetic plunger or magnet 5 in the desired direction. The magnetic plunger or magnet 5 has a latching mechanism that latches the magnetic element in its positive actuated position and therefore there is no need to continuously energize the solenoid 3. Accordingly, the microprocessor 19 de-energizes the gate 17 of the triac 7 after the magnetic plunger or magnet has been moved to its desired position. The magnetic plunger or magnet 5 therefore retains its actuated position indefinitely until the microprocessor 19 determines that it must be moved to its opposite operational position.

The substantial energy required to actuate the relay is therefore applied only momentarily when the operational state of the relay is changed. This operation conserves electrical energy and minimizes heating of the relay components. This is advantageous in refrigeration applications where low power and reduced heating are particularly desirable. It should be appreciated that the power consumption of the microprocessor that controls the relay is relatively small when compared with the power required to actuate the relay and therefore energization of the microprocessor does not significantly adversely affect the power conserving operation of the relay.

The latching mechanism of the switch 47 is actuated by energization of the coil 3 and could possibly be negatively affected by expected variations in the amplitude of the sinusoidal line voltage 11. For example, the latching mechanism might not be actuated if the line voltage drops to a minimum. On the other hand, the mechanism might be damaged or fail to operate properly in response to excessive energization of the coil 3 by increased line voltages.

The microprocessor 19 of FIG. 2 is programmed to maintain optimal energization of the coil 3 in response to fluctuations in line voltage. Thus, the pulse width W0 and the corresponding energy of the AC signal that energizes the coil 3 is set according to the expected average voltage amplitude V0 of the sinusoidal input waveform 11. In operation, the microprocessor 19 detects the relative amplitude of the sinusoidal input voltage; for example, by detecting the corresponding rectified voltage at an input 50, and then generates the associated gate pulse 45 on the line 17 after a selected time delay D0 that corresponds to the amplitude of the input voltage. The time delay D0 determines the width W0 of the associated coil pulse 48 and therefore determines the energy with which the coil 3 is energized.

If the sinusoidal input voltage increases, for example to a voltage V1, the microprocessor increases the delay for the line 17 pulse 58 to D1 and thereby reduces the width W1 of the corresponding coil pulse 52 in order to provide the required optimal energy for actuating the coil 3. Likewise, if the sinusoidal voltage decreases below V0, the microprocessor reduces the delay to less than D0 so that the energy of the associated wider coil pulse is maintained at its optimal value. The microprocessor therefore ensures that the coil 3 is energized with an optimal energy that is maintained despite expected amplitude variations in sinusoidal input line voltage.

As shown by the temperature curve of FIG. 2, the temperature of the refrigeration chamber will drop from the point 40 in response to operation of the compressor 21 until it reaches a predetermined low temperature trigger level T2 at which time 54 the microprocessor 19 will determine that the compressor 21 should be turned off. The microprocessor cannot turn off the compressor 21 during the positive phase 27 of the AC power signal, so it must wait until the next following negative phase 29 which occurs after point 41 when there is a low logic signal 51 on the zero crossing line 31.

Thereafter, the microprocessor 19 generates a triac gate activation pulse 53 on the gate line 17 to turn on the triac 7 and pass a negative energization pulse 63 through the coil 3. As explained previously, this pulse has a sufficient optimized width to create a magnetic field that moves the magnetic plunger or magnet 5 in the direction of an arrow 65 in order to open the switch 47 and turn off the compressor 21. The switch 47 is latched by a latching mechanism in this open position until the microprocessor detects an increased trigger temperature T1 at point 56 and decides to energize the coil 3 again with a positive pulse to turn on the compressor. The gate pulse 58 generated by the microprocessor therefore causes an energy optimized positive coil pulse 52 which turns on the compressor 21. Thereafter the temperature in the refrigeration compartment drops until the compressor is turned off again in response to detection of the low trigger temperature T2. The temperature therefore fluctuates between T1 and T2, according to the activation and deactivation of the compressor.

It should be understood that the circuit of FIG. 1 operates as indicated under the control of the microprocessor to regulate the temperature within the refrigeration compartment by selectively energizing and de-energizing the compressor 21. Very little power is required in the switching process, because the coil 3 only needs to be energized for a relatively short time, for example about 8.3 milliseconds, to turn on or off the compressor 21. It should be understood that this coil pulse time may be adjusted to any desired value without departing from the invention. Also, it should be understood that for simplicity of illustration, the temperature response curve of FIG. 2 has been greatly compressed in time with respect to the AC power curve. In practice, fluctuations in temperature will occur much more slowly than sinusoidal variations in the AC power signal.

FIG. 1 illustrates a circuit 69 that is used to provide a 5 volt input to the microprocessor 19. It should be understood that any desired circuitry may be provided to power the microprocessor, without departing from the invention.

Figure 3:
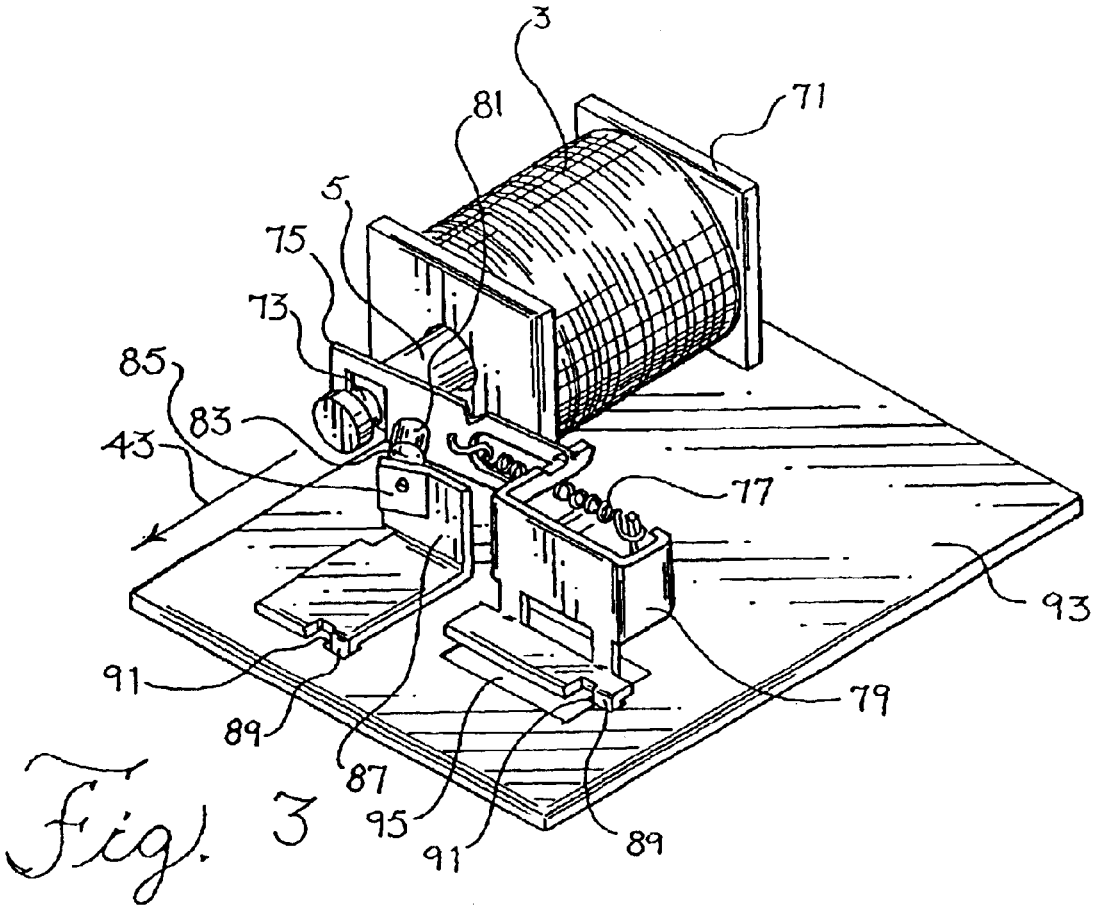
FIG. 3 is a perspective illustration of one embodiment of a relay actuated to close switch contacts.

FIG. 3 is a perspective illustration of one embodiment of a relay that is actuated to open and close switch contacts. The relay includes a coil 3 of wire that is supported on a coil holder 71. A plunger 5 is disposed for sliding motion in an axial opening of the holder 71. The plunger 5 is a hollow plastic cylinder that contains a cylindrical magnet made of, for example, Alnico, and disposed near one end. The internal magnet is disposed adjacent to one end of the plunger because it has been found that the magnetic field of the coil is concentrated at its ends when it is energized. Interaction of the magnet and magnetic field should therefore be maximized if the magnet of the plunger is located near an end of the coil. However, other positions of the magnet could be used without departing from the invention. Also, a moveable magnet could be employed without using a plunger to carry the magnet.

A front end portion 73 of the plunger 5 is engaged with a flexible metal actuator blade 75 that is biased by a spring 77 that is connected at its ends to the actuator blade 75 and a stationary metal support 79. The actuator blade 75 carries a moveable metal contact 81 that is flexed to press against an associated stationary metal contact 83 when the magnetic plunger 5 is moved in the direction of the arrow 43 by positive actuation of the coil 3.

The stationary contact 83 is disposed on a bent portion 85 of a stationary metal support 87. The supports 79 and 87 have associated downwardly projecting conductive tabs 89 that engage corresponding conductive openings 91 of a printed circuit board 93.

In operation, the spring 77 is held in tension between the stationary support 79 and the associated actuator blade 75. When the coil 3 is energized by a positive pulse, the magnetic plunger 5 moves in the direction of the arrow 43 and causes the movable contact 81 to press against the associated stationary contact 83 and thereby provide a closed circuit connection that energizes a mechanism, for example the compressor 21 of FIG. 1. Likewise, when the coil 3 is energized by a negative polarity signal, the magnetic plunger 5 moves in the opposite direction to a position shown in the plan view of FIG. 4. In this position the plunger 5 moves in the direction of the arrow 65 and therefore causes the movable contact 81 to disconnect from the associated stationary contact 83 into an open circuit that results in deactivation of associated equipment, for example the compressor 21.

Figure 4:
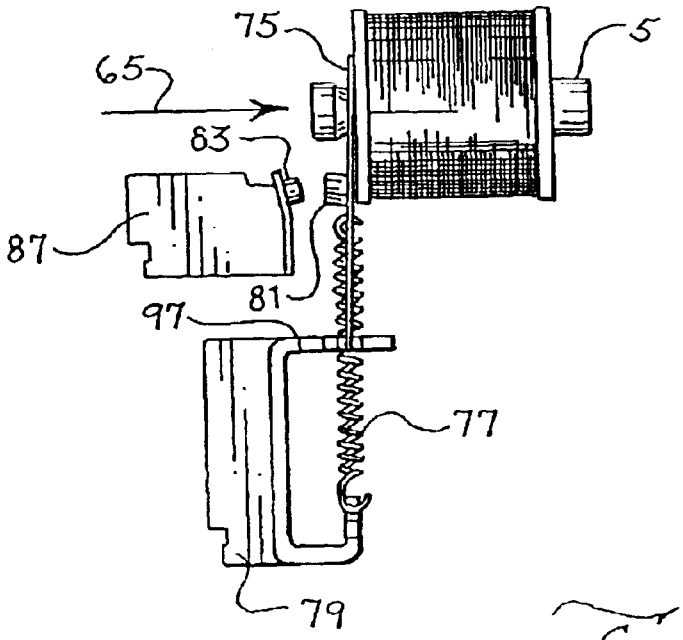
FIG. 4 is a plan view of the relay of FIG. 3 actuated to open switch contacts.

It should be appreciated that the spring 77 causes the mechanism of FIGS. 3 and 4 to be latched in either an open circuit or a closed circuit position. Thus, when the contacts 81 and 83 are closed as shown in FIG. 3, the spring 77 holds this position without requiring power until the magnetic plunger 5 is moved in an opposite direction by energization of the coil with a negative pulse. Also, when the contacts 81 and 83 are opened by movement of the magnetic plunger as shown in FIG. 4, the spring 77 holds the plunger in this open circuit position without requiring power until a positive pulse causes the plunger to move and again close the contacts.

It should be understood that the latchable relay of FIGS. 3 and 4 may be relatively easily mounted on a printed circuit board. Underlying metallic surfaces 95 may be employed to provide electrical contact for the metal stationary support 79, metal actuator blade 75 and associated moveable metal contact 81. The electrical connection for these elements may be made, for example by soldering the conductive tab 89 of the support 79 in the associated conductive opening 91. Likewise, the conducting metal stationary support 87 may be similarly soldered to the printed circuit board 93 to provide an electrical connection for the metal stationary contact 83.

It should be understood that the supports 79 and 87 are maintained in a relatively rigid, stationary configuration by attachment to the underlying printed circuit board 93. An underlying leg 97 may also be affixed to the printed circuit board 93 to support one end of the stationary support 79.

FIG. 5 illustrates an alternative embodiment of the latchable relay of the invention. As shown in FIG. 5, the coil 3, magnetic plunger 5, spring 77, actuator blade 75 and associated stationary support 79 may be contained within a housing 99. A top portion 101 of the housing 99 is engaged to enclose the mechanism of the latchable relay.

FIG. 6 illustrates a top plan view of the latchable relay of FIG. 5 with the associated movable contact 81 and stationary contact 83 in an open circuit position when the magnetic plunger 5 is moved in the direction of the arrow 65, as previously described. Likewise, in FIG. 5 the magnetic plunger 5 is moved in the direction of the arrow 43 to close the contacts as previously described. Also as previously described, the spring 77 latches the contacts in either an open or closed circuit position until an actuation signal is applied to the coil 3 to move the magnetic plunger and change the conductive condition of the contacts.

The housing of FIGS. 5 and 6 may be connected to an underlying printed circuit board (not shown) by soldered connections from portions of the stationary supports 79 and 87 that extend through the housing 99. Also, end wires of the coil 3 (not shown) extend through the housing 99 so that they may be energized to provide actuation signals for movement of the magnetic plunger 5.

Figure 7:
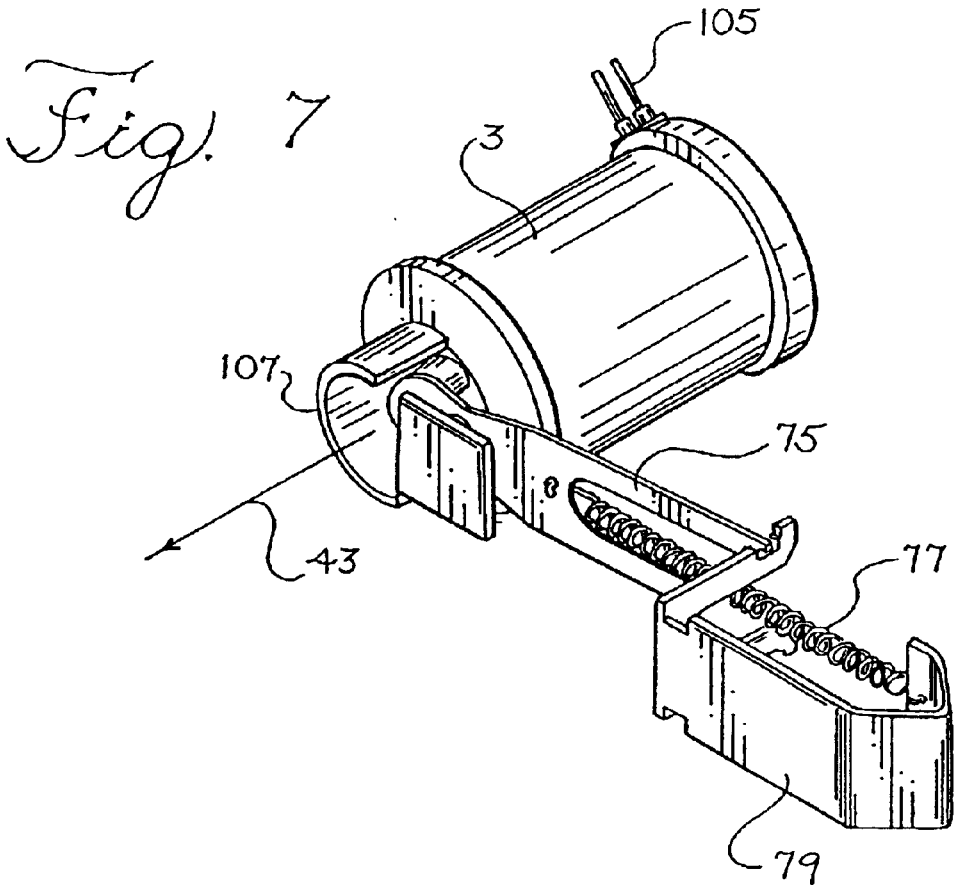
FIG. 7 is a perspective illustration of another embodiment of a relay actuated to close switch contacts without a plunger.
Figure 8:
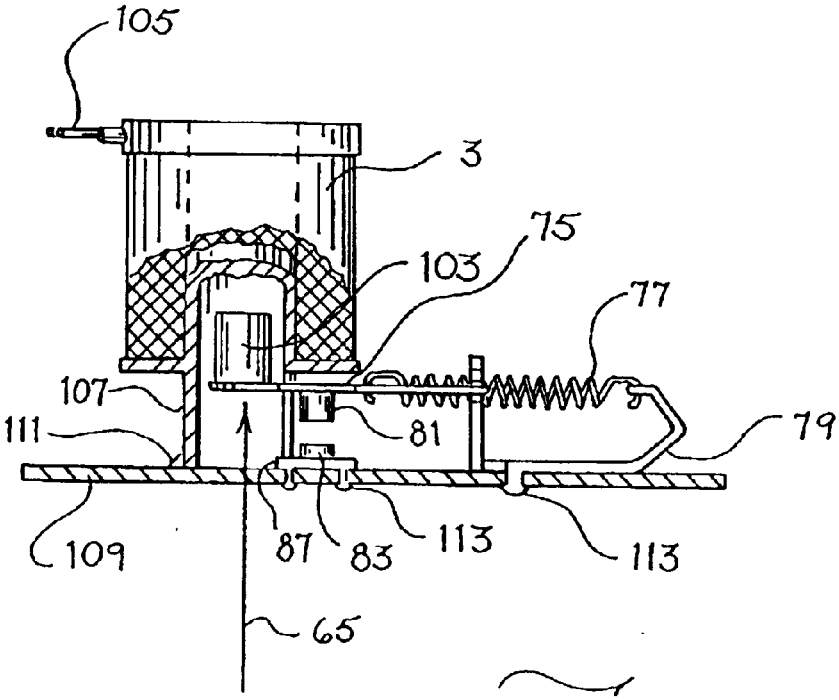
FIG. 8 is a plan view of the relay of FIG. 7 actuated to open switch contacts.

FIG. 7 illustrates a perspective view of another embodiment of the latchable relay of the invention. As shown in FIG. 7, and the corresponding plan view of FIG. 8, the coil 3 does not contain a plunger. It has been found that, when the coil 3 is actuated by an energization signal, a relatively strong magnetic field appears to be concentrated at the ends of the coil. It may therefore not be necessary to provide a plunger with an associated internal magnet disposed within and adjacent to the end of the coil. As shown in FIGS. 7 and 8, a magnet 103, for example an Alnico magnet, may be disposed adjacent to an end of the coil 3 without requiring a plunger. When the coil 3 is energized by a negative energization pulse, the magnet 103 is caused to move in the direction indicated by the arrow 65. As shown in FIG. 8, this movement causes associated contacts 81 and 83 to be disengaged. As previously described, the contacts are latched in this position by operation of the spring 77 in association with a stationary support 79 and an associated actuator blade 75. FIG. 7 illustrates a closed circuit conductive connection of the contact elements 81 and 83 when the coil 3 is energized, for example by wires 105, to move the magnet 103 in the direction indicated by the arrow 43.

With reference to FIGS. 7 and 8, the coil 3 may be supported by a partial cylindrical wall 107 on a printed circuit board 109, for example by epoxy or other adhesive 111. Further as shown in FIG. 8, the metal stationary supports 79 and 87 may be conductively connected to the printed circuit board 109, for example by soldering tab elements 113 that extend through conductive openings in the printed circuit board.

Figure 9:
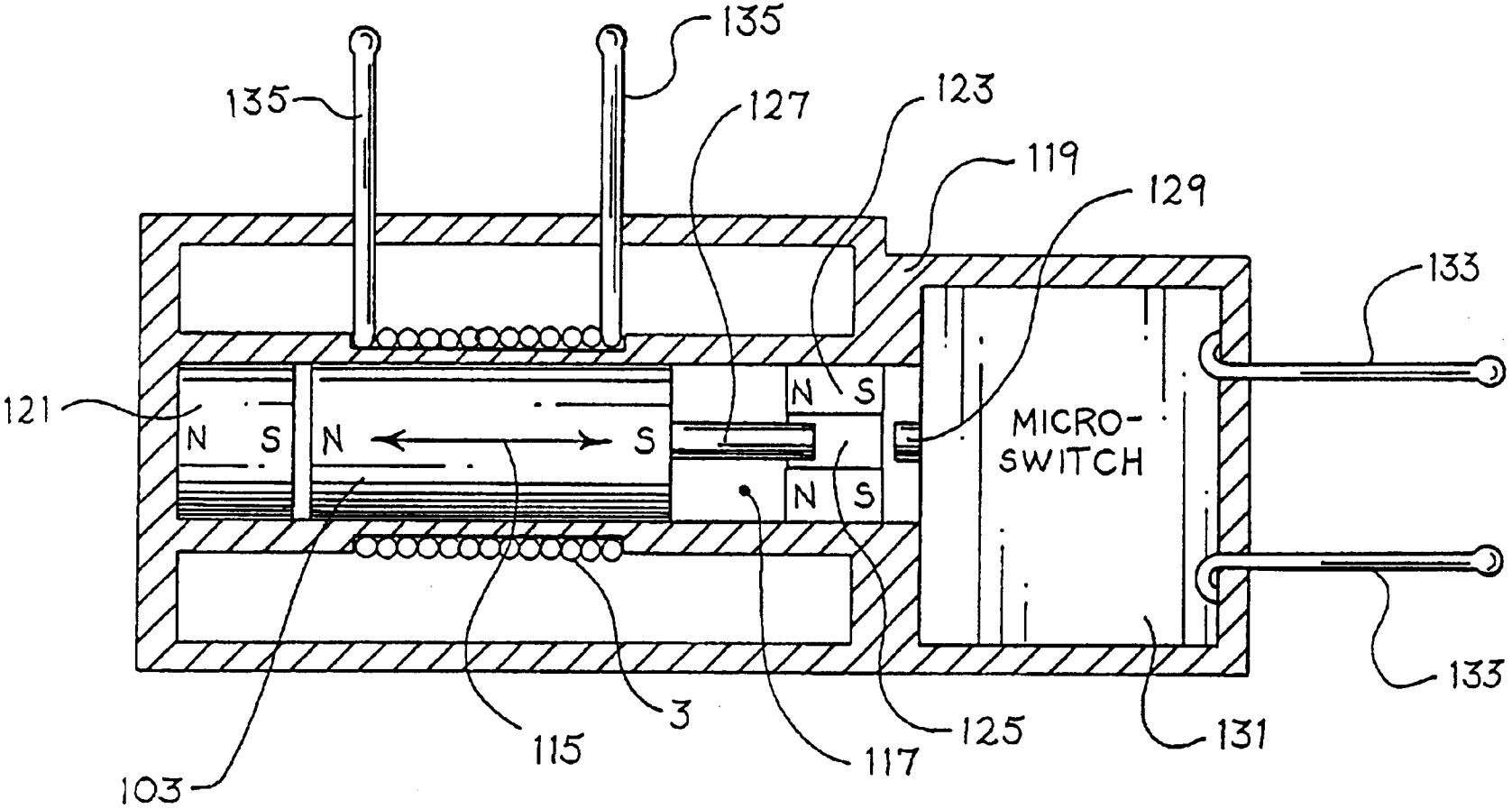
FIG. 9 is a cross-sectional view of another embodiment of a relay with a magnetically actuated latching mechanism.

FIG. 9 illustrates a partial cross-sectional view of another embodiment of the latchable relay of the invention which uses magnetic force to latch the relay. As shown in FIG. 9, a movable cylindrical magnet 103 is disposed to move axially within a cylindrical bore 117 of a housing 119 in response to energization of the coil 3 as previously described. As shown in FIG. 9, a first stationary end magnet 121 is disposed to attract the movable magnet 103 when the coil 3 is energized to cause the movable magnet 103 to move adjacent to the stationary magnet 121. Likewise, a cylindrical stationary end magnet 123 with a central bore 125 is disposed at the opposite end of the housing 119 to attract the opposite end of the movable magnet 103 when it is energized by the coil 3 to move adjacent to the cylindrical end magnet 123. The end magnets 121 and 123 respectively maintain a latched position of the magnet 103 until energization of the coil 3 causes the magnet to move in a direction away from its latched position.

The end magnets 121, 123 may be made of any suitable material, for example Alnico, and may be provided with sufficient magnetism to maintain a fixed latched position of the magnet 103, but still allow the magnet to be moved in response to energization of the coil 3. For this purpose, a gap may be maintained between the ends of the movable magnet 103 and the associated end magnets 121 and 123, in order to reduce the amount of force that is required to move the magnet 103 away from a latched position. The gap may be maintained, for example by end walls (not shown) that would separate the stationary end magnets from the ends of the associated movable magnet 103.

As shown in FIG. 9, one end of the movable magnet 103 retains an actuator pin 127 that moves through the central bore 125 of the cylindrical end magnet 123 when the coil 3 is actuated to cause the magnet 103 to move adjacent to the end magnet 123. The pin 127 presses and activates a button 129 of a microswitch 131 in order to operate associated equipment, for example the compressor 21 of FIG. 1. It should be understood that when the coil 3 is actuated to move the magnet 103 in the opposite direction, the pin 127 disengages from the button 129 and therefore deactivates the microswitch. Wires 133 connect the microswitch to the associated apparatus that is to be controlled. Likewise, wires 135 are used to energize the coil 3 and therefore move the magnet 103 as described.

Although end magnets 121 and 123 have been disclosed in the embodiment of FIG. 9, it should be understood that unmagnetized magnetically attractive metal end pieces made of, for example steel (not shown), could be used instead of the magnets 121 and 123. These metal end pieces would attract the ends of the moveable magnet 103 and would thereby latch the movable magnet as previously described. These metal end pieces could have a gap maintained between themselves and the magnet as previously described, or could contact the magnet to provide a maximum latching holding force. The coil 3 could be positioned to concentrate magnetic fields of a desired polarity and strength in the end stationary metal pieces and thereby enhance the operation of the switch of FIG. 9.

Figure 10:
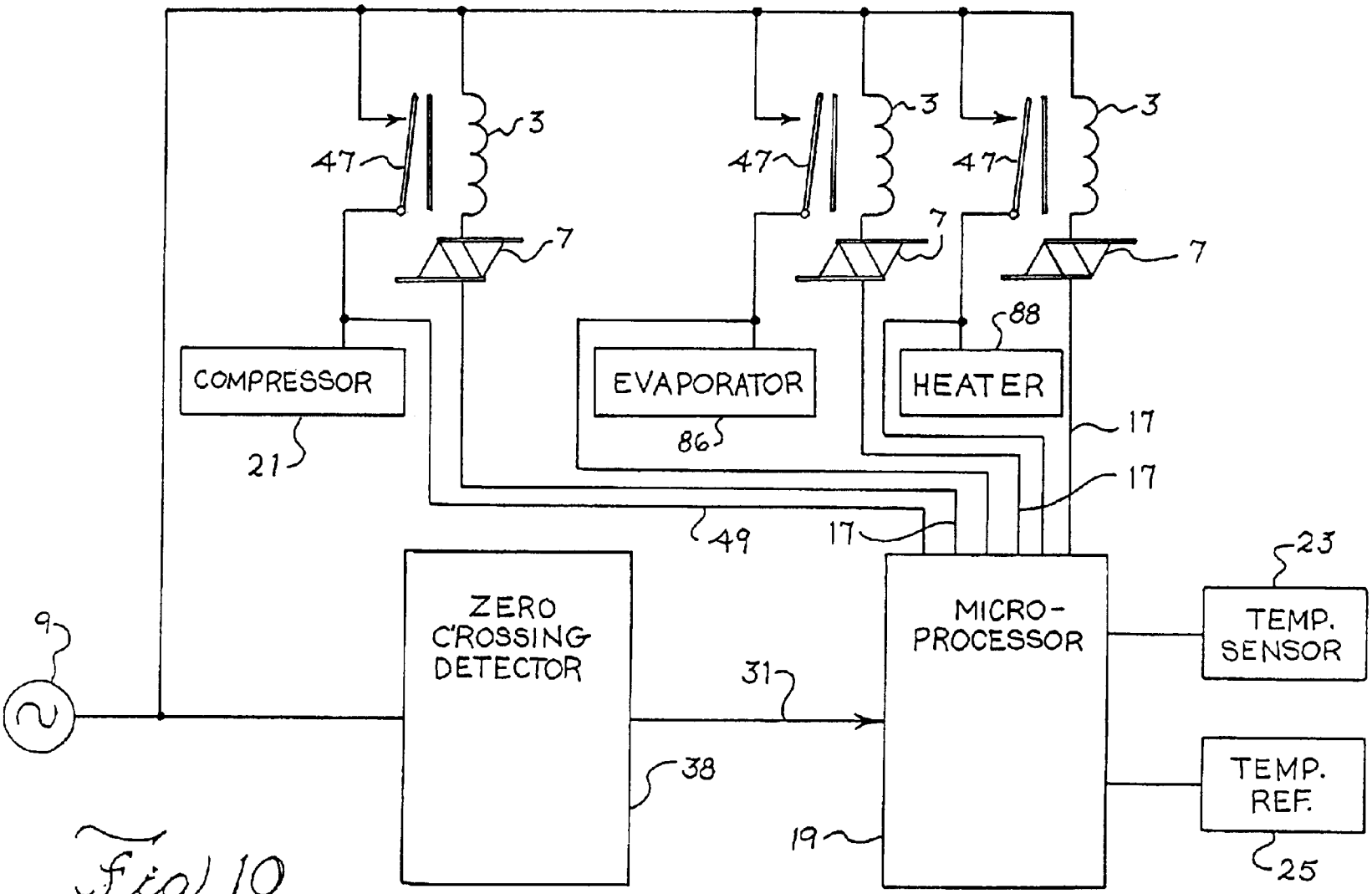
FIG. 10 is a diagram of a circuit that uses several latchable relays in accordance with the invention to operate various devices.

FIG. 10 illustrates a simplified circuit and block diagram of a system that utilizes several triacs 7 and associated coils 3 and switches 47 to control a compressor 21, evaporator 86 and defroster heater 88. The compressor, evaporator and heater are controlled by the microprocessor 19 in the same manner as was described with respect to FIG. 1.

Although the solenoid-actuated latchable relay has been disclosed for operating refrigeration equipment, it should be understood that this relay could be used to control any electrical or mechanical equipment. Also, this relay could be employed to define operational electrical conditions other than on or off. Thus, the relay could be used to provide any desired signals for control purposes or even for generating electrical information or data.

Variations and modifications of the disclosed embodiments of the invention may be made without departing from the scope of the invention. The aforementioned description is therefore intended to be illustrative rather than limiting and it should be understood that the following claims and their equivalents set forth the scope of the invention.

What is claimed is:

1. A method for operating a relay having at least one coil and at least one magnet moveable between at least two positions, comprising the steps of:

supplying a sinusoidal AC signal;

associating one position of said at least one magnet with one phase polarity of the sinusoidal signal;

associating the other position of said at least one magnet with another phase polarity of the sinusoidal signal;

applying to the coil a single pulse of a selected phase polarity of the sinusoidal signal; and moving said at least one magnet to the position associated with the phase polarity of said pulse.

2. The method of claim 1, further including the step of holding the magnet in the position to which it moves until a different pulse polarity is applied.

3. The method of claim 1, further including the step of providing a triac to apply said single pulse of a selected phase polarity.

4. The method of claim 1, further including the step of providing a microprocessor to determine the required position of the magnet and to generate the corresponding pulse for moving the magnet to the required position.

5. The method of claim 1, further including the step of turning on at least one electrical device in response to moving the magnet to said one position and turning off said at least one device in response to moving the magnet to the other position.

6. The method of claim 1, further including the step of turning on one or more of a condenser, an evaporator and a defrosting heater in response to movement of one or more of said magnets.

7. The method of claim 1, further including the step of using a microprocessor to cause one or more triacs to apply one or more of said pulses to control the position of one or more magnets and the associated operation of one or more electrical devices.

8. The method of claim 1, further including the step of providing a microprocessor to determine the required position of one or more magnets and to generate corresponding pulses from triacs for moving the magnets to positions required to operate one or more electrical devices.

9. The method of claim 1, further including the step of holding said at least one magnet in a selected position by biasing at least one spring arm until a different polarity phase of said pulse is applied.

10. The method of claim 1, including the step of holding said at least one moveable magnet in a selected position by interaction with a stationary magnetic element.

11. A method for operating a relay having a coil and a moveable magnet, comprising the steps of:

selectively energizing the coil with momentary signals of different polarity;

moving the magnet to one selected position in response to signals of one polarity;

moving the magnet to another selected position in response to signals of another polarity; and holding the magnet in any selected position until a change in energization polarity of said signal causes the magnet to move to a different position.

12. A relay, comprising;

a coil;

a triac for energizing the coil with a single pulse derived from a selected polarity phase of a sinusoidal input signal;

a magnet for moving to predefined positions in response to energization of said coil with said pulse;

a microprocessor for controlling said triac to provide a selected pulse for moving the magnet to a selected position;

a switch responsive to the position of said magnet;

a latch for holding the position of said magnet until it is moved in response to energization of said coil; and an electrical device responsive to the operation of said switch.

13. The relay of claim 12, wherein said electrical device is a compressor for a refrigerator.

14. The relay of claim 12, wherein said microprocessor determines the desired operation of said electrical device, the associated position of the magnet required to provide said desired operation; and the polarity phase of the sinusoidal input signal required to energize the coil through the triac to achieve the desired position of the magnet and operation of the electrical device; said microprocessor turning on the triac for a predefined time required to move the magnet to its desired position and provide the desired operation of the electrical device.

15. The relay of claim 14, further including a refrigeration compressor, evaporator and defrosting heater and means for operating these devices in response to the temperature sensed by said microprocessor in a refrigeration compartment.

16. The relay of claim 12, wherein said magnet includes a plunger and said coil includes an axial opening within which said plunger slides to move to said predefined positions of said magnet.

17. A method for conserving power in operation of a relay, comprising the steps of:

providing a relay switchable between operational states;

selectively applying electrical energy to the relay;

moving the relay to each operational state in response to said selectively applied electrical energy; and latching the relay in each operational state so that electrical energy is used only to change the operational state of the relay.

18. The method of claim 17, further including the step of applying a selected portion of a phase of an AC electrical power signal to change the operational state of said relay.

19. The method of claim 18, further including the step of maintaining the magnitude of the energy of said selected portion of said AC electrical power signal at a predefined optimum level in response to variations in the voltage amplitude of the power signal.

20. The method of claim 17, further including the step of using a microprocessor to cause at least one triac to sample a selected portion of a phase of an AC electrical power signal and applying said sample to change the operational state of said relay.

21. The method of claim 17, including spring biasing electrical contacts to define latched operational states of said relay.

22. The method of claim 17, including magnetically biasing electrical contacts to define latched operational states of said relay.

* * * * *